US006708831B1

(12) United States Patent
Balassi

(10) Patent No.: US 6,708,831 B1
(45) Date of Patent: Mar. 23, 2004

(54) VERTICAL SUPPORT FOR CRUTCHES

(76) Inventor: Tilio J. Balassi, 54 Chesterfield Lakes Rd., Chesterfield, MO (US) 63005

( * ) Notice: Subject to any disclaimer, the term of this patent is extended or adjusted under 35 U.S.C. 154(b) by 70 days.

(21) Appl. No.: 10/133,303

(22) Filed: Apr. 26, 2002

(51) Int. Cl.[7] ..... A61H 3/02

(52) U.S. Cl. ..... 211/62; 224/915; 248/351; 248/163.1; 248/176.1; 135/65

(58) Field of Search ..... 135/65, 66, 68; 211/62; 224/915; 248/351, 163.1, 176.1

(56) References Cited

U.S. PATENT DOCUMENTS

| | | | | |
|---|---|---|---|---|
| 3,606,898 A | | 9/1971 | Harocopo | |
| 4,091,828 A | | 5/1978 | Jorgensen | |
| 4,997,001 A | | 3/1991 | Di Carlo | |
| 5,282,486 A | | 2/1994 | Hoover | |
| 5,339,849 A | * | 8/1994 | Stutz | 135/66 |
| D390,301 S | | 2/1998 | Peterson | |
| 6,015,165 A | | 1/2000 | Artemis et al. | |
| 6,561,206 B1 | * | 5/2003 | Wilkkinson | 135/65 |

FOREIGN PATENT DOCUMENTS

| | | | | |
|---|---|---|---|---|
| EP | 0 015 034 A1 | * | 2/1979 | A61H/3/02 |
| EP | 1136054 A1 | * | 9/2001 | A61H/3/02 |
| FR | 2785970 | * | 5/2000 | F16M/13/08 |
| GB | 2 193 638 A | * | 2/1988 | A61H/3/02 |
| WO | WO 98/47462 | * | 10/1998 | A61H/3/02 |

* cited by examiner

*Primary Examiner*—Robert Canfield

(57) ABSTRACT

A support apparatus for crutches that can be configured in one position to hold a pair of crutches in an upright position that is convenient for the user to reacquire for use and takes up less floor space than laying the crutches on the floor. In a second configuration the apparatus is stored in a compact area so that it will not interfere with the normal use of the crutch to which it is attached. The apparatus is modular and can be designed to work with a variety of existing or new designs of crutches.

18 Claims, 4 Drawing Sheets

VERTICAL SUPPORT FOR CRUTCHES

BACKGROUND OF THE INVENTION

1. Field of the Invention

The present invention relates to crutches and more particularly pertains to a new vertical support for crutches for stowing crutches in a position that is convenient for the user to reacquire the crutches for use.

2. Description of the Prior Art

The use of crutches is known in the prior art. More specifically, crutches heretofore devised and utilized are known to consist basically of familiar, expected and obvious structural configurations, notwithstanding the myriad of designs encompassed by the crowded prior art, which have been developed for the fulfillment of countless objectives and requirements.

Known prior art includes U.S. Pat. No. 3,606,898, which teaches a vertical crutch support device that attaches directly to one or more crutches to support the crutches in a vertical orientation. U.S. Pat. No. 4,091,828 teaches a cane with supports to provide additional stability and to allow the user to set the cane in an upright position. U.S. Pat. No. 4,997,001 teaches a cane with adjustable feet to convert from a single tipped configuration to a multi-tipped configuration, which would allow the cane to remain in an upright position when not in use. U.S. Pat. No. 5,282,486 teaches a crutch with a powered telescoping armature specifically for transitioning the user from a sitting to a standing position.

While these devices fulfill their respective, particular objectives and requirements, the aforementioned patents do not disclose a new vertical support for crutches. The inventive device includes one support apparatus attached to one crutch to hold the crutch in a vertical position and a second apparatus that can attach to either crutch to attach the second crutch to the crutch with the support apparatus to provide the same support to the second crutch.

In these respects, the vertical support for crutches according to the present invention substantially departs from the conventional concepts and designs of the prior art, and in so doing provides an apparatus primarily developed for the stowing of crutches in a position that is convenient for the user to reacquire the crutches for use.

SUMMARY OF THE INVENTION

In view of the foregoing disadvantages inherent in the known types of crutches now present in the prior art, the present invention provides a new vertical support for crutches construction wherein the same can be utilized for stowing crutches in a position that is convenient for the user to reacquire the crutches for use.

The general purpose of stowing crutches in a position that is convenient for the user to reacquire the crutches for use of the present invention, which will be described subsequently in greater detail, is to provide a new vertical support for crutches apparatus and method which has many of the advantages of the crutches mentioned heretofore and many novel features that result in a new vertical support for crutches which is not anticipated, rendered obvious, suggested, or even implied by any of the prior art crutches, either alone or in any combination thereof.

To attain this, the present invention generally comprises one support apparatus that may be attached to one crutch to hold the crutch in a vertical position without the user's aid and a second apparatus that can attach to either the support crutch or a second crutch to couple the second crutch to the crutch with the support apparatus to provide the same upright support to the second crutch as the first crutch enjoys.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the stowing crutches in a position that is convenient for the user to reacquire the crutches for use of description and should not be regarded as limiting.

As such, those skilled in the art will appreciate that the conception, upon which this disclosure is based, may readily be utilized as a basis for the designing of other structures, methods and systems for carrying out the purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vertical support for crutches apparatus and method which has many of the advantages of the crutches mentioned heretofore and many novel features that result in a new vertical support for crutches, which is not anticipated, rendered obvious, suggested, or even implied by any of the prior art crutches, either alone or in any combination thereof.

It is another object of the present invention to provide a new vertical support for crutches, which may be easily and efficiently manufactured and marketed.

It is a further object of the present invention to provide a new vertical support for crutches, which is of a durable and reliable construction.

An even further object of the present invention is to provide a new vertical support for crutches which is susceptible of a low cost of manufacture with regard to both materials and labor, and which accordingly is then susceptible of low prices of sale to the consuming public, thereby making such vertical support for crutches economically available to the buying public.

Still yet another object of the present invention is to provide a new vertical support for crutches, which provides in the apparatuses and methods of the prior art some of the advantages thereof, while simultaneously overcoming some of the disadvantages normally associated therewith.

Still another object of the present invention is to provide a new vertical support for crutches for stowing crutches in a position that is convenient for the user to reacquire the crutches for use.

Yet another object of the present invention is to provide a new vertical support for crutches, which includes one support apparatus that may be attached to or integrated into one crutch to hold that crutch in a vertical position without the user's aid and a second apparatus that can attach to or be integrated into either the first support crutch or a second crutch to couple the crutches together so that the support apparatus of the first crutch can support both crutches in an upright position.

Still yet another object of the present invention is to provide a new vertical support for crutches that can be attached to existing crutches to provide support for holding one or more crutches in an upright position.

Even still another object of the present invention is to provide a new vertical support for crutches that can be integrated into the design of new crutches to provide support for holding one or more crutches in an upright position.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
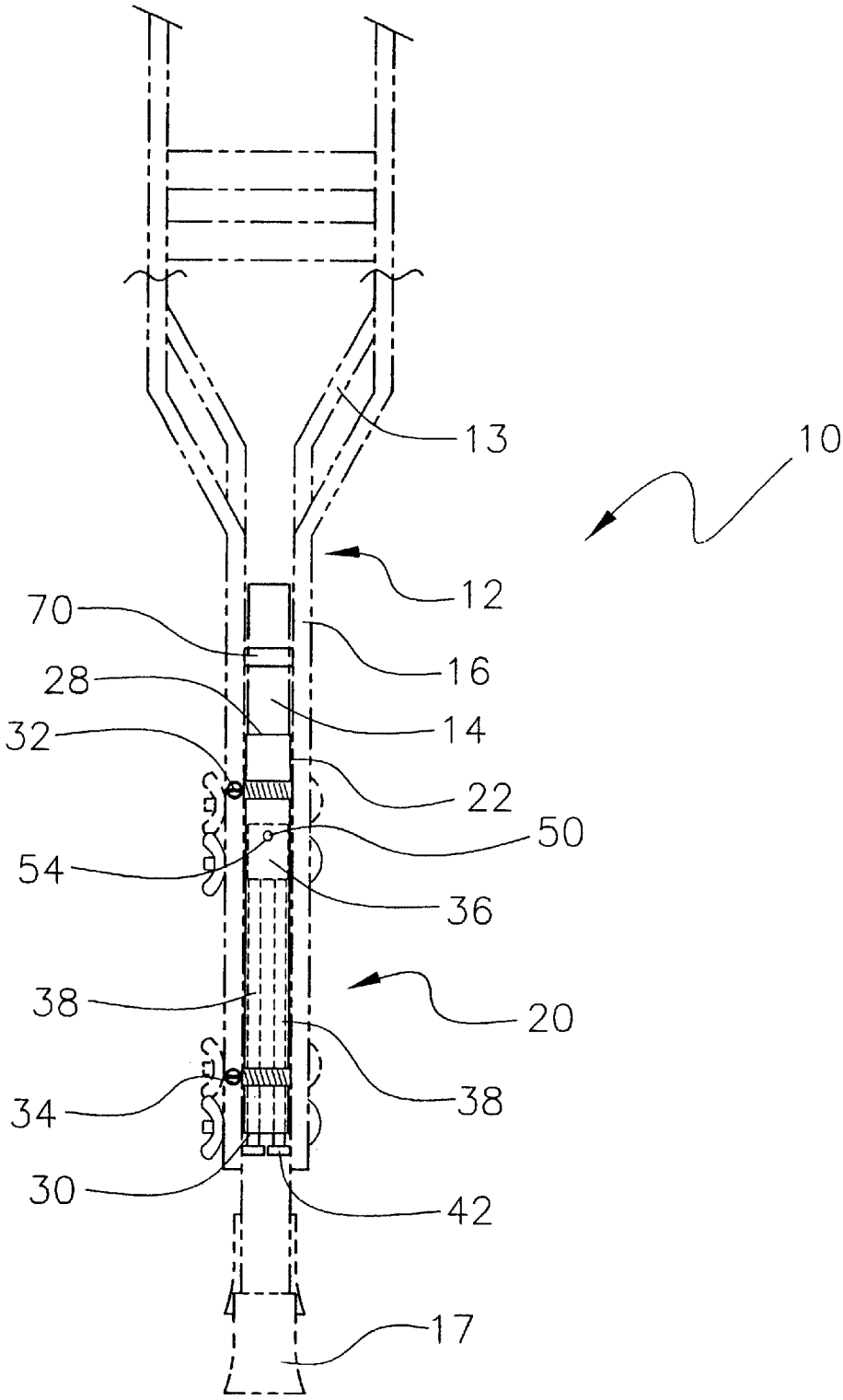
FIG. 1 is a side view of a new vertical support for crutches according to the present invention. The invention is depicted in its modular embodiment with the support legs retracted in the stored position.

With reference now to the drawings, and in particular to FIGS. 1 through 4 thereof, a new vertical support for crutches embodying the principles and concepts of the present invention and generally designated by the reference numeral 10 will be described.

As best illustrated in FIGS. 1 through 4, the vertical support for crutches 10 generally comprises a leg assembly 20 and a coupler 70.

The leg assembly 20 may comprise a body 22 which may comprise a hollow rigid conduit. The hollow conduit of the body 22 may be defined as having a body interior 24 and body exterior 26. The body 22 is principally used to accommodate the shuttle 36 and to contain the legs 38 when the leg assembly 20 is in the stored position. The body 22 depicted in the illustrations is cylindrical, although the invention is not so limited. The body 22 may conform to triangular, rectangular, square, oval, irregular or composite elongated conduit depending on the mechanical design or aesthetic quality desired. Furthermore it is also anticipated that the interior shape of the conduit may not correspond with the exterior shape of the body 22. The body 22 may possess two opposite ends referred to as the top end 28 and the bottom end 30.

The shuttle 36 may be positioned within the body interior 24 so as to be able to slide along the length of the body 22 from the top end 28 to the bottom end 30. The shuttle 36 may be shaped to generally conform to the body interior 24 in whole or in part. For example if the body interior 24 was triangular the shuttle 36 may be triangular conforming to match all three sides and all three angles of the body interior or It could be in the shape of a hexagon contacting all three sides but none of the angles of the body interior. Similar configurations for the triangular shape in the example may include pentagonal touching tree sides and one angle, truncated triangle touching three sides and two angles, circular contacting tree sides and no angles, etc. Without reference to the specific shape of the body interior or the shuttle 36 the shuttle 36 will be able to nest within the body interior so as to allow for the shuttle to travel the length of the body 22 from end to end.

One or more legs 38 may be connected to the shuttle. The leg 38 may comprise a rigid armature tipped with a foot 42. The leg may be connected to the shuttle 36 via a flexible connection so that it can move from an attitude generally parallel with the body to an attitude oblique to the body. The flexible connection may comprise a leg joint 40 which may include a plurality of mechanical means to allow movement of the leg 38 in the appropriate arc. Such means may include a hinge, a ball joint, an axis pin, a section of flexible material, etc. The foot 42 of the leg 38 may comprise a conformable grip or non-skid pad designed to provide contact with a ground surface. The foot may be constructed from a variety of materials such as rubber, durable plastic, cork, leather, etc.

Figure 3:
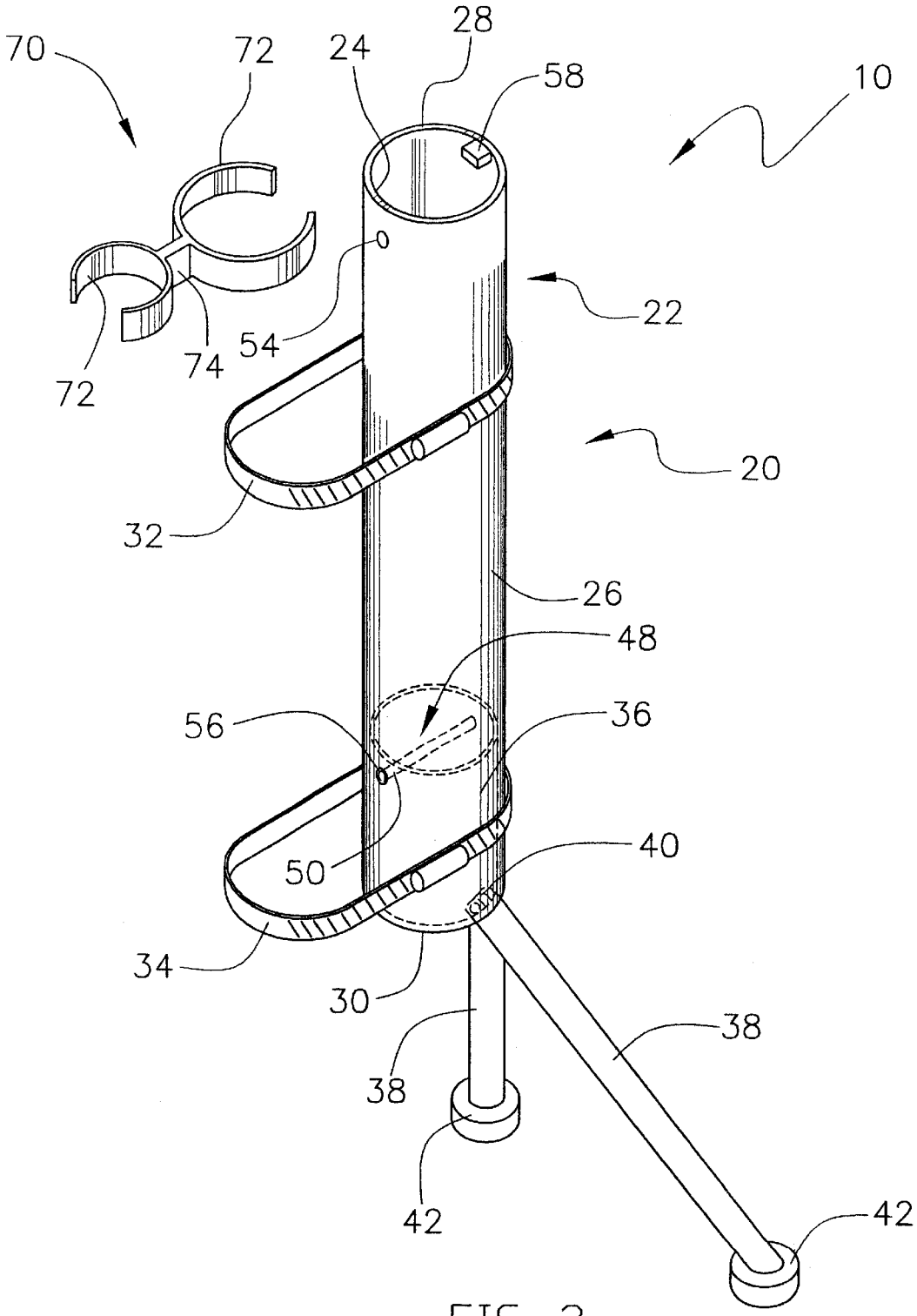
FIG. 3 is a schematic perspective view of the modular embodiment of the present invention.

The shuttle may also include a retaining device 48 to secure the shuttle 36 in one or more positions in the body 22. Such a retaining device 48 may include a biased detent 50 that would engage an indent 52 located in the body interior 24. The detent 50 is depicted in FIG. 3 as a cylinder containing a coil spring and ball. The ball would act as the detent 50 and the coil spring as the biasing means, but the invention is not so limited. For example, the detent could comprise a raised surface of an elongated prong and the biasing means may comprise the biasing of the prong against its natural position creating a leaf spring apparatus to provide bias for the detent engaging the indent. Conversely, the detent may be located on the body 22 and the indent contained in the shuttle 36. Many other methods of detent/indent apparatus are known to those skilled in the art and could be practiced alternatively to the examples given here without departing from the spirit and scope of the present invention.

In one preferred embodiment, a biased detent is incorporated into the shuttle and two indents 52 are located on the body interior 24. One of the indents is located generally near the top end 28 of the body 22 and is referred to as the top indent 54. Another indent is located generally near the bottom end 30 of the body 22 and is referred to as the bottom indent 56.

When the detent 50 of the shuttle is engaged in the top indent 54, the leg assembly 20 is in the stored position, and the legs 38 may be held parallel to the body 22, or the legs 38 may be entirely or partially retracted in the body interior. When detent 50 is engaged in the bottom indent 56, the leg assembly 20 is in the stand position, and the legs 38 may be held oblique to the body 22, or a majority portion of the legs 38 may be extended beyond the body 20.

In embodiments utilizing a single leg 38 it may be necessary to increase the size of the foot 42 to be able to provide lateral stability. The foot may comprise a bar mounted perpendicular to the leg, similar in design to that of a kick stand or two legged ironing board.

Figure 4:
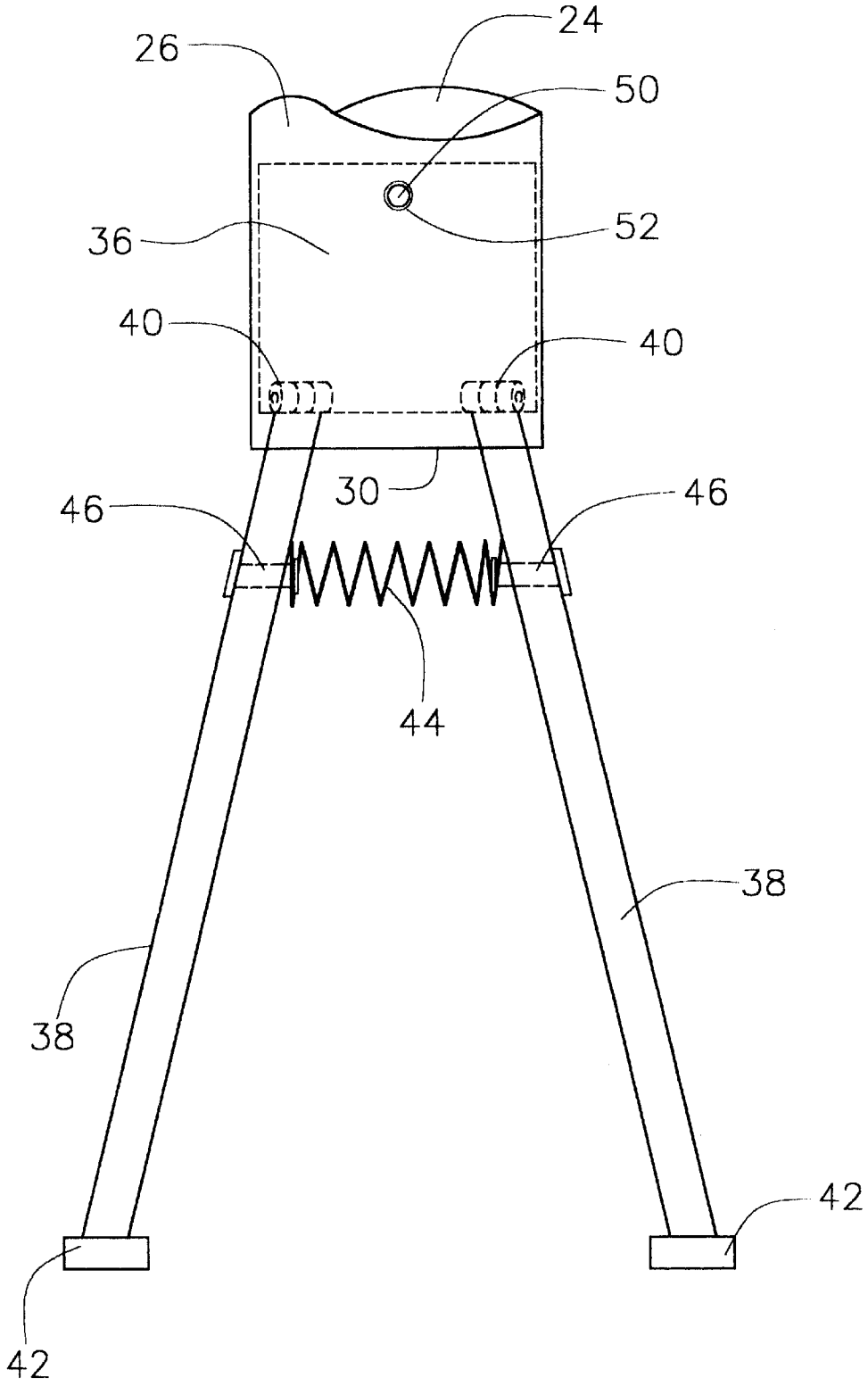
FIG. 4 is a schematic side view of the present invention.

In embodiments utilizing more than one leg, a means to deploy the legs may be necessary. Such means to deploy the legs may include the addition of a separating bias 44 between the various legs. In FIG. 4 one such means is illustrated, and demonstrates a two-legged leg assembly 20. The drawing figure shows the leg assembly 20 in the stand position. The shuttle 36 is positioned at the bottom end 30 of the body 22. The two legs 38 are positioned oblique to the body 20. Between the two legs 38 is a separating bias 44, depicted as a coil spring attached to both legs 38 by a spring mount 46. In the illustration, the spring mount is depicted as a rivet that has been placed through the shaft of each leg and fixed to the opposite ends of the coil spring. Optionally, the invention may employ a leaf spring with its ends strapped to each leg meeting near the parting of two legs (crotch) on the shuttle 36, or a rubber or resistant block of material located at the crotch of the two legs 38, or a sealed air bladder located near the crotch of the two legs 38 to provide the biasing means between the various legs. Using any of the aforementioned methods, the legs would repel from each other in the standing position.

Alternatives to the retaining device 48 and the separating bias 44 will be obvious to those of relative skill in the art. Combinations of the two means may also be employed. For example, the foot 42 ends of the legs 38 may have a separating bias 44 when retracted in the body interior 24 would be biased against the body interior 24 so that the bias exerted by the foot against the body interior would cause the shuttle 36 to be relatively fixed in the stored position. The separating bias 44 may also be able to provide the splayed legs 38 in the stand position with sufficient biasing to secure the shuttle at the bottom end 30 of the body interior 24 by the bias force mechanically translated from the sides of the legs 38 to the bottom end 30 of the body 22.

To assure that the shuttle 36 remains in the body interior, it may be beneficial to add retention blocks 58 to the bottom end 30 and/or the top end 28 of the body interior 24. Retention blocks 58 may comprise an obstacle to the sliding of the shuttle 36 in the body interior 24. The obstacles may take many forms, including but not limited to, a constriction of the conduit comprising the body interior 24, one or more projections within the body interior 24 that would interfere with the passage of the shuttle 36, or an end cap connected to the body 22, etc.

The leg assembly 20 may be attached to the first crutch 12 with a variety of mounting devices. In the illustrations of one preferred embodiment, a pair of screw thread (or bicycle) clamps are used as an upper mount 32 and a lower mount 34. The upper and lower mounts encircle both the body 22 and the crutch leg 14. When the clamps are sufficiently tightened the leg assembly 20 is fixed to the first crutch 12. Although this structure is depicted in the figures, the invention is not so limited. For example, screw holes could be integrated on the body exterior 26 to engage holes in the crutch leg 14 or the crutch upper support 16 through holes designed for adjusting the length of the first crutch 12. Screws from the leg assembly could be screwed into the wooden sections of a wooden crutch 12. Alternative latching devices may be employed such as, for example, hook mounts, spring fasteners, tension locks, pin blocks, and cotter pins, hook and loop fasteners, adhesives, etc.

The coupler 70 couples the first crutch 12 to one or more second crutches 13. In one preferred embodiment, the coupler 70 comprises a pair of connecting collars 72 fixed to a connecting link 74 so that the two connecting collars 72 face opposite to each other. The link may span any distance between the connecting collars 72, or the two connecting collars 72 may be connected directly to each other with no intervening space. The object of the design is for the coupler 70 to act as a link between a first crutch 12 and one or more second crutches 13. The example illustrated in FIG. 3 shows connection collars 72 that may comprise flexible encircling armatures that could spread out when being connected to a crutch 12 or 13 and to spring back to form a spring biased grip against the portion of a crutch 12 or 13. The illustration in FIG. 3 shows two different sized connecting collars 72 designed to grip two different portions of crutches 12 or 13, but the invention is not so limited. For example, the connecting collars 72 may be the same sizes designed to grip similar portions of matching crutches 12 and 13. It is anticipated in the use of the coupler 70 that one connecting collar 72 may be relatively permanently attached to one of a pair of crutches 12 or 13. With one permanently attached the user need not worry about loosing the coupler 70.

Alternatives to the illustrated coupler 70 may include connecting collars 72 with a center ring for connection to a crutch 12 so that the two sets of connecting collars, with one mounted on each side of the first crutch 12, may allow a second crutch to be mounted on either or both sides of the first crutch 12.

In FIG. 1, the leg assembly is shown in the stored position. The majority of the legs 38 are inserted into the body interior 24 and the shuttle 36 is located near the top end 28 of the body 22. The leg assembly is connected by an upper mount 32 and a lower mount 34 to the crutch leg 14. The crutch leg 14 may be attached to the crutch upper supports 16 with two sets of bolts and wing nuts through a set of adjustment holes that allow for the length adjustment of the first crutch 12. The coupler 70 is shown attached to the crutch leg 14 of the first crutch 12 just above the leg assembly 20. A second crutch 13 is depicted mounted on the coupler 70 at a level just higher than the first crutch 12.

Figure 2:
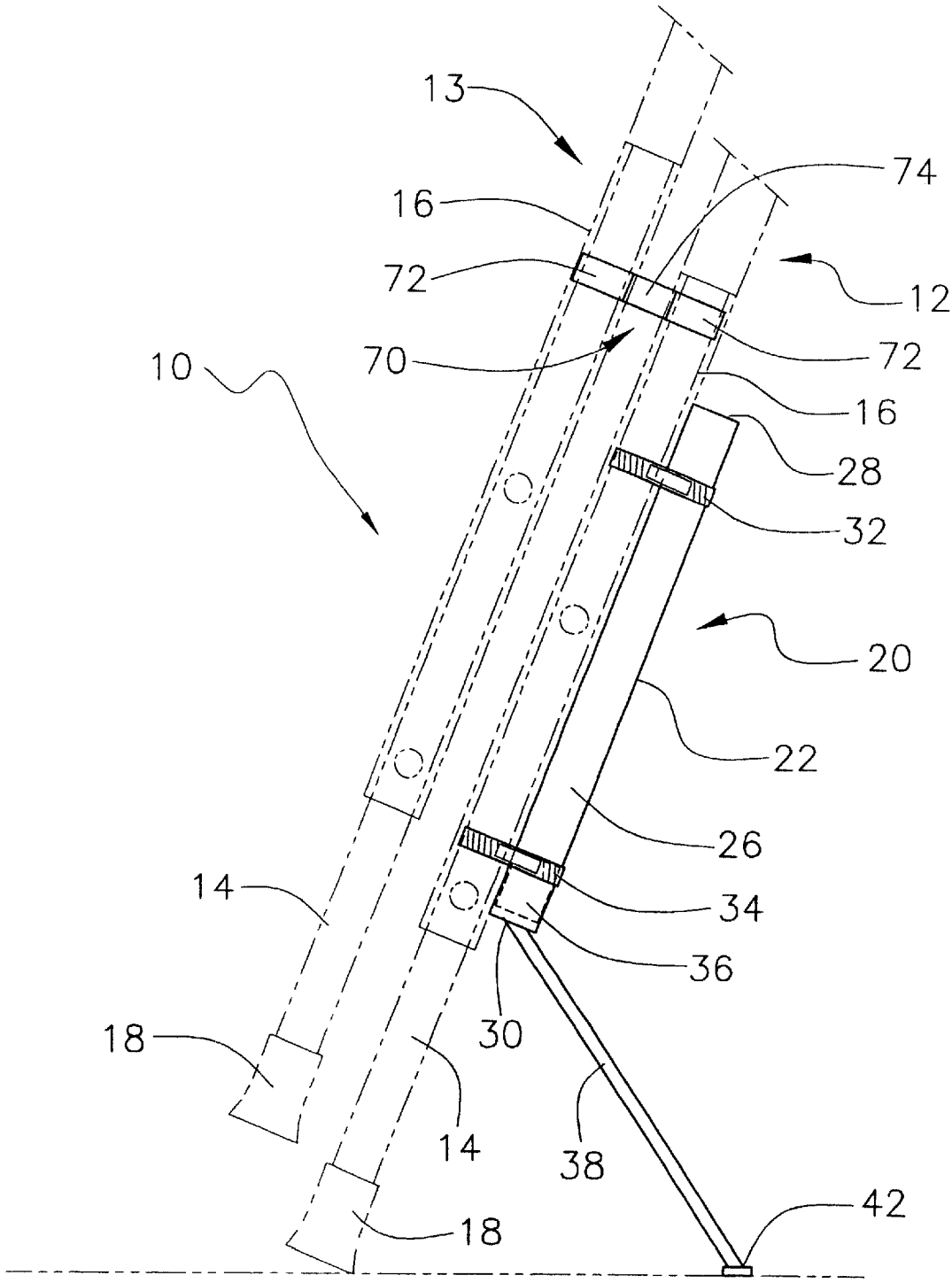
FIG. 2 is a front view of the present invention. The invention is depicted in its modular embodiment with the support legs deployed in the stand position.

In FIG. 2, the leg assembly is in the stand position. The majority of the legs 38 are extended out of the body interior 24 and the shuttle 36 is located near the bottom end 30 of the body 22. The feet 42 of the legs are in contact with the ground. The two feet 42 of the leg assembly 20 and the crutch foot 18 of the first crutch 12 form a tripod for supporting the weight of the first crutch 12 and the second crutch 13. The leg assembly is connected by an upper mount 32 and a lower mount 34 to the crutch leg 14 of the first crutch 12. The coupler 70 is shown attached to the crutch leg 14 of the first crutch 12 just above the leg assembly 20. The second crutch 13 is depicted mounted on the coupler 70 at a level just higher than the first crutch 12.

FIG. 3 shows the coupler 70 and the leg assembly 20 without the first 12 or second 13 crutch. The leg assembly 20 is depicted in the stand position. The majority of the legs 38 are extended out of the body interior 24 and the shuttle 36 is located near the bottom end 30 of the body 22. The detent 50 spans across the shuttle 36. The detent 50 in aligned with the bottom indent 56 and the top indent 52 is located near the top end 28 of the body 22. The upper mount 32 and the lower mount 34 are expanded showing the space for the crutch leg 14. The coupler is also shown in a location relative to the leg assembly 20 representative of the location when mounted on the first crutch 12.

FIG. 4 shows the lower section of the leg assembly 20 with the legs 38 in the stand position. The majority of the legs 38 are extended out of the body interior 24 and the shuttle 36 is located near the bottom end 30 of the body 22. The feet 42 of the legs are in contact with the ground. Between the two legs 38 is a separating bias 44 that is attached to each leg 38 with a retaining device 48

In use, the leg assembly 20 is connected to the first crutch 12. with one or more mounting devices. One preferred embodiment favors the use of a pair of mounts, an upper mount 32, and a lower mount 34. As the user is using the first crutch 12 for walking, the leg assembly 20 is in the stored position with the shuttle 36 located near the top end 28 of the body 22. The shuttle 36 is held at the top by a detent 50 located on the shuttle 36 engaged with an indent 52 located near the top end 28 of the body interior 24. A majority of the legs 38 may be located in the body interior 24.

When the user decides to stop walking and possibly sit down, the leg assembly is changed from the stored position to the stand position. This transformation occurs in the following manner. Force is exerted on the shuttle 36, either by pushing directly on the shuttle 36 through the opening at the top end 28 of the body 22, or by pulling the feet 42 or legs projecting from the bottom end 30 of the body 22. With the application of sufficient force, the detent 50 will release from the top indent in the body interior. The user will then continue to apply force as the shuttle slides down the body interior until it reaches the bottom end of the body interior and the detent 50 engages the bottom indent 56.

The user may then reposition the legs 38 from their original parallel attitude to the body 22 to an oblique attitude to the body 22. This step may occur without user assistance if the leg assembly is fitted with a separating bias 44. The leg assembly 20 is now in the stand position.

The user may then set the first crutch 12 on a level section of ground or floor. The feet/foot 42 of the leg assembly 36 and the crutch foot 18 of the first crutch 12 define an area wherein the center of gravity of the crutch will focus. The legs 38 provide stability to the first crutch to stand without need any other assistance such as leaning against a wall or other object.

After standing the first crutch 12, the user can then take the second crutch 13 and connect it to the first crutch 12 by connecting the connecting collar 72 of the coupler 70, which is already fixed to the crutch leg 14 of the first crutch 12 and the crutch leg 14 of the second crutch 13. The coupler is attached to the first 12 and second 13 crutches so that the center of gravity does not shift to an area outside the area defined by the supporting feet 18 and 42. The leg assembly 20 in the stand position then supports both crutches 12 and 13 in a vertical position that is easy to access and takes up less floor space than laying the crutches on the floor.

When the user desires to use the crutches 12 & 13 for walking, the operation is reversed. First, the second crutch 13 is detached from the first crutch 12 by decoupling the coupler 70. Sufficient force is applied to the two crutches spreads the connecting collar 72 attached to the second crutch 13 and the collar slips off. The legs 38 are then inserted in the body interior 24 by reorienting the legs 38 from their oblique position to a position relatively parallel to the body 22. This may be made more or less difficult depending on whether or not the legs 38 are fitted with a separating bias 44. The legs are then pushed into the body interior 24 by applying sufficient pressure to unseat the detent 50 from the bottom indent 54 and sliding the shuttle 36 up through the body interior 24 from the bottom end 30 to the top end 28 where the detent 50 will engage with the top indent 52 and hold the shuttle 36 in the stored position.

With respect to the above-description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support device for one or more crutches comprising a leg assembly comprising a body for attaching to a crutch, a leg for supporting the crutch in an upright position, and a flexible structure mounting the leg to the body, the leg being movable between a first position and a second position;

wherein the flexible structure comprises a shuttle attaching the leg to the body, and the shuttle is movable in the body of the leg assembly between a first position and a second position; and a coupler for attaching one crutch to another crutch.

2. The support device of claim 1 further comprising one or more clamps facilitating attachment to the crutch.

3. The support device of claim 1 wherein the leg includes a foot.

4. The support device of claim 1 wherein the flexible structure comprises a hinge.

5. The support device of claim 1 wherein the first position is characterized by the leg being positioned substantially parallel to the body.

6. The support device of claim 1 wherein the second position is characterized by the leg being positioned substantially oblique to the body.

7. The support device of claim 1 wherein the first position is characterized by the leg being stored substantially in the leg assembly.

8. The support device of claim 1 wherein the second position is characterized by the leg being positioned substantially outside the leg assembly.

9. The support device of claim 7 wherein the first position is characterized by the leg being positioned substantially parallel to the leg assembly.

10. The support device of claim 8 wherein the second position is characterized by the leg being positioned substantially oblique to the leg assembly.

11. The support device of claim 1 wherein the coupler comprises a pair of opposing connecting collars.

12. The support device of claim 1 wherein the leg assembly includes a pair of legs, and additionally comprises a separating bias that biases the legs away from each other.

13. A support device for a pair of crutches comprising a leg assembly comprising:

a body including:

a hollow conduit;

a top and bottom end; and an interior and exterior surface;

a shuttle nested in the body and being slidable between a first position and a second position in the interior of the body;

a mount for attaching the leg assembly to the crutch;

two legs connected to the shuttle comprising:

an articulated end that is connected to the shuttle that allows the legs to move between a first position and a second position; and a foot end including a gripping tip for forming a tripod with the foot of the crutch forms a tripod that can support the pair of crutches in an upright position; and a coupler for attaching one crutch to another crutch.

14. The support device of claim 13 wherein the mount comprises at least one clamp.

15. The support device of claim 13 wherein the shuttle includes securing means for securing the shuttle in one or more positions.

16. The support device of claim 15 wherein the securing means comprises a biased detent engaging with an indent.

17. The support device of claim 16 wherein the detent is located on the shuttle.

18. The support device of claim 16 wherein the indent is located on the interior of the body.

* * * * *